US006283201B1

(12) United States Patent
Lee et al.

(10) Patent No.: US 6,283,201 B1
(45) Date of Patent: Sep. 4, 2001

(54) HEAT-RADIATING STRUCTURE

(76) Inventors: Sui Yung Lee, No. 22, Alley 12, Lane 348, Tzu-wen Road, Taoyuan City; Chien-hung Hsu, No.1, Alley 39, Lane 202, I-hsin-i Road, Kaohsiung City, both of (TW)

( * ) Notice: Subject to any disclaimer, the term of this patent is extended or adjusted under 35 U.S.C. 154(b) by 0 days.

(21) Appl. No.: 09/667,619

(22) Filed: Sep. 22, 2000

(51) Int. Cl.[7] ..... F28F 7/00

(52) U.S. Cl. ..... 165/185; 165/80.3; 165/104.33; 361/697; 361/704; 361/709; 174/16.3; 257/706; 257/720; 257/722

(58) Field of Search ..... 165/80.3, 80.4, 165/80.5, 185, 104.33, 104.26; 361/695–709; 174/15.2, 16.3; 257/706, 722, 718, 719, 720

(56) References Cited

U.S. PATENT DOCUMENTS 3,834,457 * 9/1974 Madsen ..... 165/104.33
4,660,625 * 4/1987 Musinski ..... 165/185
5,161,090 * 11/1992 Crawford et al. ..... 361/385
5,411,077 * 5/1995 Tousignant ..... 165/104.33
5,441,102 * 8/1995 Burward-Hoy ..... 165/104.33
5,465,782 * 11/1995 Sun et al. ..... 165/104.26
5,579,830 * 12/1996 Giammaruti ..... 165/104.33
5,697,434 * 12/1997 Burward-Hoy ..... 165/185
5,959,837 9/1999 Yu ..... 361/697
6,148,906 * 11/2000 Le et al. ..... 165/104.33

* cited by examiner

*Primary Examiner*—Marvin M. Lateef
*Assistant Examiner*—Terrell McKinnon
(74) *Attorney, Agent, or Firm*—Dougherty & Troxell

(57) ABSTRACT

A heat-radiating structure includes a closed container connected to an end of a thermal pipe that is connected at another end to a heat source. The closed container is made of a heat-conductive material and filled with heat-absorptive ethanol. Outer wall surfaces of the closed container may be provided with parallel ribs or other raised portions in different patterns to increase the contact area of the closed container with ambient air and thereby speed up heat radiation from the closed container. No other power-consuming cooling fan is needed to help the heat radiation from the closed container into the ambient environment.

4 Claims, 3 Drawing Sheets

HEAT-RADIATING STRUCTURE

FIELD OF THE INVENTION

The present invention relates to a heat-radiating structure including a closed container that is connected to an end of a thermal pipe and is filled with heat-absorptive ethanol. Outer wall surfaces of the closed container may be provided with raised portions to increase the contact area of the container with the ambient air to speed up heat radiation thereof. The closed container may also be internally provided with at least one thermal net to further increase the heat-absorbing area of the heat-radiating structure.

BACKGROUND OF THE INVENTION

U.S. Pat. No. 5,959,837 entitled "Heat-radiating Structure for CPU", a full copy of which is attached to this Specification as a reference, discloses a radiating seat 1 connected to a front side of a central processing unit (CPU) . Bent thermal pipes 22 are upward extended from a central portion of the radiating seat 1. To enhance quick transfer of heat produced by the CPU, a radiating member 2 is provided at another ends of the thermal pipes 22, and a cooling fan 3 is further connected to the radiating member 2. The heat-radiating structure for CPU disclosed in U.S. Pat. No. 5,959,837 is complicate and has slow heat radiating speed. Moreover, the cooling fan 3 consumes additional power supply to help the heat radiation of the disclosed structure. Therefore, it is desirable to develop an improved heat-radiating structure to eliminate drawbacks existing in the conventional heat-radiating structure and to provide enhanced heat radiating performance.

SUMMARY OF THE INVENTION

A primary object of the present invention is to provide a heat-radiating structure that has simple structure and provides improved heat radiation performance without the need of a power-consuming cooling fan.

Another object of the present invention is to provide a heat-radiating structure that includes a closed container that is filled with heat-absorptive ethanol and internally provided with at least one thermal net, and has toothed or otherwise uneven outer wall surfaces to increase heat-radiating areas to speed up heat radiation thereof.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
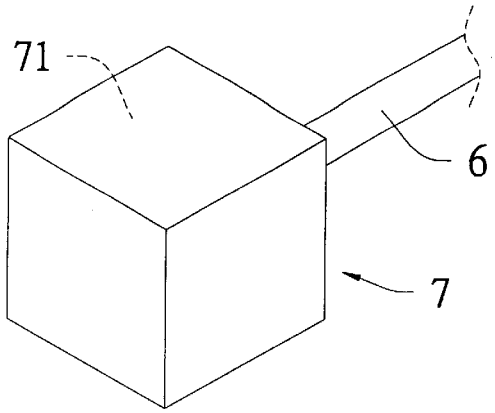
FIG. 1 is a perspective showing an appearance of a heat-radiating structure according to a first embodiment of the present invention.
Figure 2:
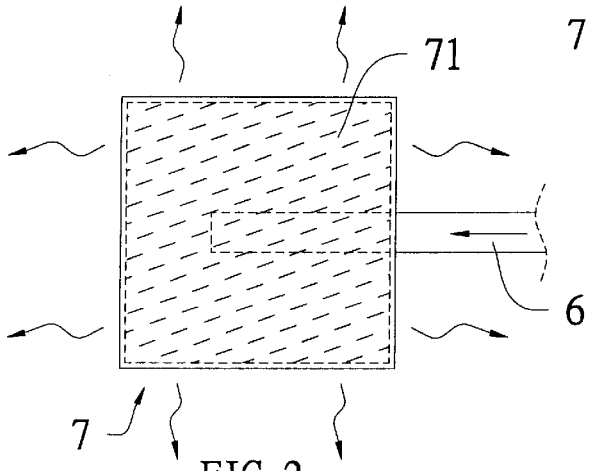
FIG. 2 is a sectioned side view of the heat-radiating structure of FIG. 1.

Please refer to FIGS. 1 and 2 that are perspective and sectioned side views, respectively, of a heat-radiating structure according to a first embodiment of the present invention. The heat-radiating structure of the present invention mainly includes a fully closed container 7 connected to a thermal pipe 6. An end of the thermal pipe 6 is connected to a heat source and another end of which is extended into the closed container 7. The closed container 7 is made of a heat-conductive material and has plain outer wall surfaces. The closed container 7 is filled with ethanol 71 that is capable of absorbing heat. When the thermal pipe 6 transfers heat produced by a heat source to the closed container 7, the ethanol 71 filled in the closed container 7 quickly absorbs the transferred heat, and the heat-conductive material of the closed container 7 and ambient cold air surrounding the closed container 7 together enable the heat absorbed by the ethanol 71 in the closed container 7 to quickly radiate from the closed container 7 in all directions as indicated by the arrows in FIG. 2. The heat-radiating structure of the present invention has very simple structure and does not require any power-consuming cooling fan to speed up radiation of heat while it provides good heat-radiating performance.

Figure 3:
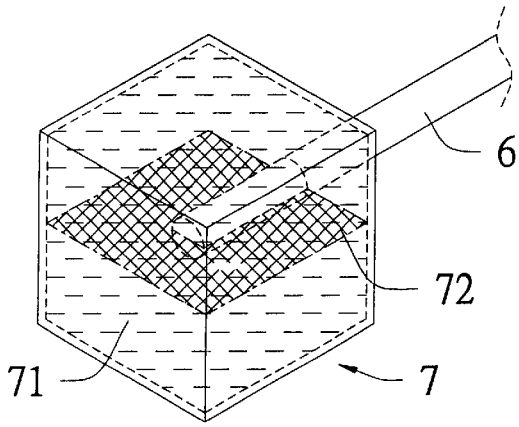
FIG. 3 is a perspective showing an internal structure of a heat-radiating structure according to a second embodiment of the present invention.
Figure 4:
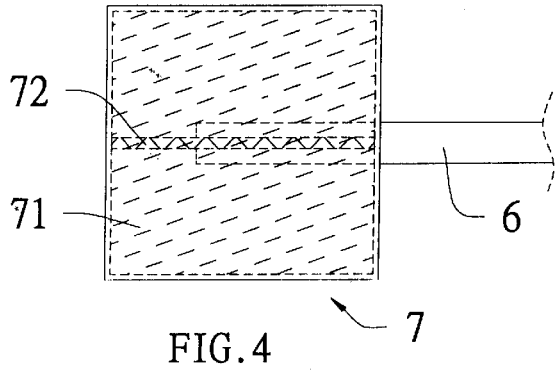
FIG. 4 is a sectioned side view of the heat-radiating structure of FIG. 3.

FIGS. 3 and 4 are perspective and sectioned side views, respectively, of a second embodiment of the present invention. This second embodiment is different from the first embodiment in that a thermal net 72 made of a heat-conductive material is provided in the closed container 7 to connect to the end of the thermal pipe 6 extended into the closed container 7. The thermal net 72 provides increased area in the closed container 7 to absorb heat transferred thereto. Moreover, since the large area thermal net 72 is completely surrounded by the ethanol 71 that has excellent heat absorbing ability, heat transferred to the closed container 7 and absorbed by the thermal net 72 would be quickly absorbed by the ethanol 71 that has lower temperature than the net 72 and then quickly radiated into ambient cold air surrounding the closed container 7.

Figure 5:
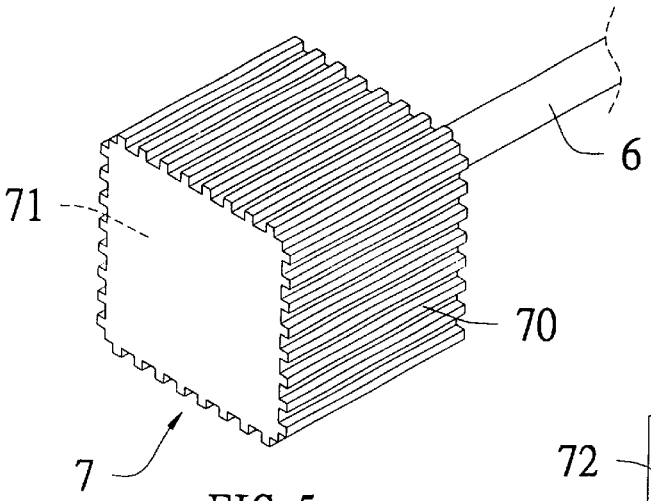
FIG. 5 is a perspective showing an appearance of a heat-radiating structure according to a third embodiment of the present invention.
Figure 6:
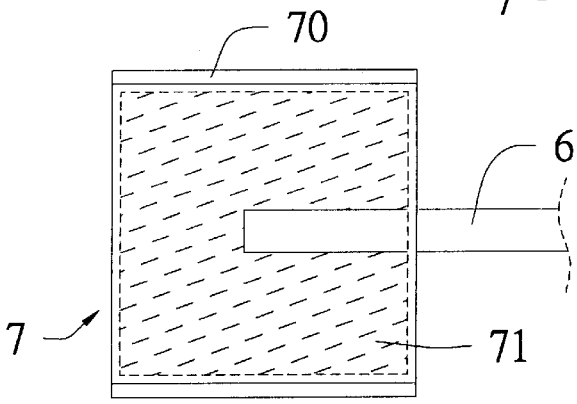
FIG. 6 is a sectioned side view of the heat-radiating structure of FIG. 5.

FIGS. 5 and 6 are perspective and sectioned side views, respectively, of a third embodiment of the present invention. This third embodiment is generally similar to the first embodiment, except that the closed container 7 has toothed outer wall surfaces to largely increase the area on the closed container 7 contacting with ambient air for even quicker heat radiation. The toothed outer wall surfaces of the closed container 7 are formed by providing a plurality of parallelly spaced ribs 70 on all four sidewalls of the closed container 7. It is understood that there are many patterns other than the toothed surfaces that can be employed to increase the contact area of the closed container 7 with the ambient air.

Figure 7:
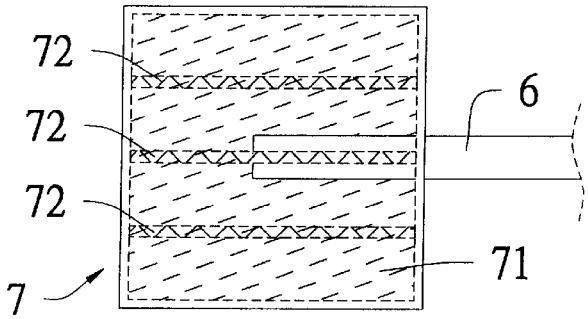
FIG. 7 is a sectioned side view of a heat-radiating structure according to a fourth embodiment of the present invention.

Please now refer to FIG. 7 in which a sectioned side view of a fourth embodiment of the present invention is shown.

This fourth embodiment is different from the third embodiment shown in FIGS. 5 and 6 in that at least one thermal net 72 is provided in the closed container 7 in parallel with the end of the thermal pipe 6 extended into the closed container 7 to speed up heat conduction in the closed container 7. Since the at least one thermal net 72 provides increased contact area with the heat-absorbing ethanol 71, heat transferred to the closed container 7 can be more quickly radiated therefrom.

Figure 8:
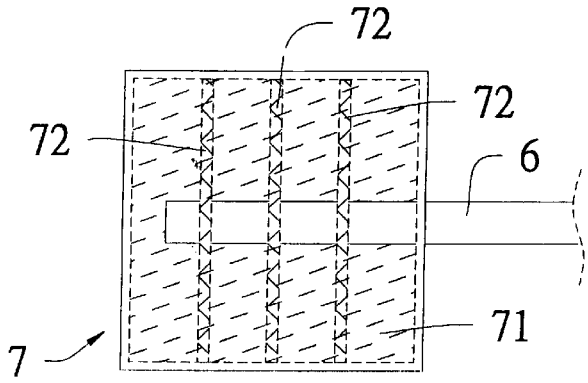
FIG. 8 is a sectioned side view of a heat-radiating structure according to a fifth embodiment of the present invention.

FIG. 8 is a sectioned side view of a fifth embodiment of the present invention. This fifth embodiment is different from the fourth embodiment in that the at least one thermal net 72 in the ethanol-filled closed container 7 is arranged in perpendicular to the thermal pipe 6.

Figure 9:
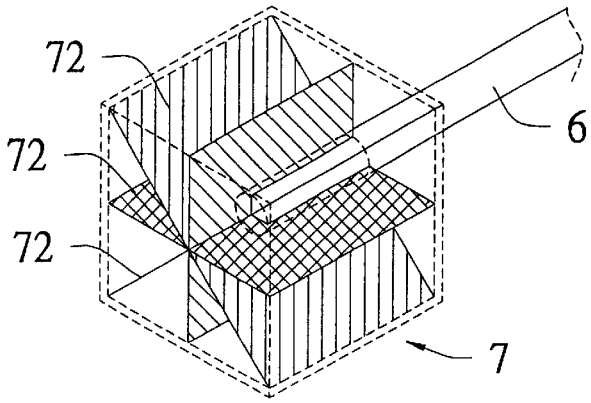
FIG. 9 is a perspective view showing an internal structure of a heat-radiating structure according to a sixth embodiment of the present invention.
Figure 10:
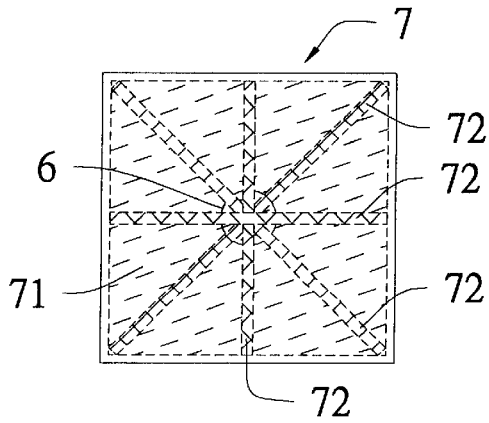
FIG. 10 is a sectioned front view of the heat-radiating structure of FIG. 9.
Figure 11:
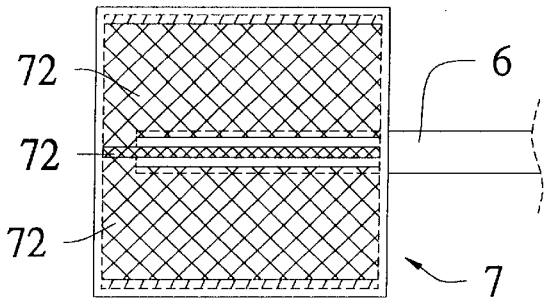
FIG. 11 is a sectioned side view of the heat-radiating structure of FIG. 9.

FIGS. 9, 10 and 11 are sequentially perspective, sectioned front, and sectioned side views of a heat-radiating structure according to a sixth embodiment of the present invention. This sixth embodiment is different from the fourth and the fifth embodiments in that the at least one thermal net 72 in the ethanol-filled closed container 7 is connected to the thermal pipe 6 to radially extend from the thermal pipe 6.

With the above arrangements, the heat-radiating structure of the present invention is very simple in its structure and is capable of quickly radiating heat into the ambient environment without the need of additional cooling fan. The heat-radiating structure of the present invention is therefore power saving and practical for use.

What is claimed is:

1. A heat-radiating structure that does not require any external power supply to speed up heat radiation therefrom, comprising a closed container connected to a first end of a thermal pipe that is connected at a second end to a heat source, said closed container being made of a heat-conductive material and filled with ethanol for absorbing heat transferred to said closed container, said closed container being internally provided with at least one thermal net connected to the first end of said thermal pipe extending into said closed container, wherein said at least one thermal net connected to said thermal pipe extends in a direction perpendicular to said thermal pipe.

2. A heat-radiating structure as claimed in claim 1, wherein said closed container is provided at outer wall surfaces with raised portions to increase contact area of said closed container with ambient air to speed up heat radiation from said closed container.

3. A heat-radiating structure that does not require any external power supply to speed up heat radiation therefrom, comprising a closed container connected to a first end of a thermal pipe that is connected at a second end to a heat source, said closed container being made of a heat-conductive material and filled with ethanol for absorbing heat transferred to said closed container, said closed container being internally provided with at least one thermal net connected to the first end of said thermal pipe extending into said closed container, wherein said at least one thermal net connected to said thermal pipe radially extends from said thermal pipe.

4. A heat-radiating structure as claimed in claim 3, wherein said closed container is provided at outer wall surfaces with raised portions to increase contact area of said closed container with ambient air to speed up heat radiation from said closed container.

* * * * *